US006780122B2

(12) United States Patent
Belanger

(10) Patent No.: US 6,780,122 B2
(45) Date of Patent: Aug. 24, 2004

(54) GOLF SWING TRAINING DEVICE

(76) Inventor: Joseph Warren Belanger, 4601 Bit & Spur Rd., Mobile, AL (US) 36608

( * ) Notice: Subject to any disclaimer, the term of this patent is extended or adjusted under 35 U.S.C. 154(b) by 0 days.

(21) Appl. No.: 10/223,248

(22) Filed: Aug. 20, 2002

(65) Prior Publication Data

US 2004/0038743 A1 Feb. 26, 2004

(51) Int. Cl.[7] ..... A63B 69/36
(52) U.S. Cl. ..... 473/257
(58) Field of Search ..... 473/257, 219, 473/221, 238, 261, 264, 266, 268, 270, 271, 273, 274, 275, 276, 277

(56) References Cited

U.S. PATENT DOCUMENTS 2,150,580 A * 3/1939 Crowley ..... 473/273
2,441,647 A * 5/1948 Seeley, Jr. ..... 473/276
2,611,610 A * 9/1952 Hara ..... 473/271
3,017,183 A * 1/1962 Chalcroft ..... 473/483
3,397,892 A * 8/1968 Stahl ..... 473/276
3,698,721 A * 10/1972 Stewart ..... 473/264
3,776,555 A * 12/1973 Hagaman ..... 473/221
4,145,044 A * 3/1979 Wilson et al. ..... 473/483
4,583,738 A * 4/1986 Fava ..... 473/263
4,758,000 A * 7/1988 Cox ..... 473/208
4,940,232 A * 7/1990 Chen ..... 473/416
5,013,044 A * 5/1991 Hesselbart ..... 473/218
5,039,105 A * 8/1991 Ro ..... 473/258
5,252,076 A * 10/1993 Kelleher ..... 473/438
5,288,074 A * 2/1994 Scheurer ..... 473/277
5,303,926 A * 4/1994 Owens et al. ..... 473/261
5,375,833 A * 12/1994 Marier, Jr. ..... 473/261
5,562,216 A * 10/1996 Falconio ..... 211/33
5,672,118 A * 9/1997 Robbie ..... 473/257
5,678,698 A * 10/1997 Cabral ..... 211/33
5,718,344 A * 2/1998 Joldeson et al. ..... 211/206
6,257,418 B1 * 7/2001 Allen et al. ..... 211/1.3
6,343,998 B1 * 2/2002 Tarulli et al. ..... 473/273
6,575,844 B1 * 6/2003 Gray ..... 473/277

* cited by examiner

*Primary Examiner*—Stephen P. Garbe
*Assistant Examiner*—Nini F. Legesse
(74) *Attorney, Agent, or Firm*—Arent Fox PLLC

(57) ABSTRACT

A golf training device to help a golfer improve a golf swing. The device includes a base member, a mast member, and at least one swing indicator. The mast member is coupled with the base member and has opposite ends and a plurality of holes. The swing indicator(s) are insertable into at least one of said plurality of holes.

17 Claims, 9 Drawing Sheets

GOLF SWING TRAINING DEVICE

BACKGROUND OF THE INVENTION

1. Field of the Invention

This invention relates to golf training devices. More specifically, the present invention relates to the systems and methods for improving a golf swing by providing visual and indicators that allow a golfer to perfect various aspects of the golf swing.

2. Description of the Related Art

The key to a successful golf game is in the golf swing. Golf is a sport which requires a substantial amount of skill and practice. There are many technical aspects of a golf swing that can affect the characteristics of a golf shot. For example, stance, backswing and follow-through can affect the distance and accuracy of a golf shot. In order to be successful at golf, a golfer should have a consistent, yet technically sound swing. That is, a golfer wants a good swing, but also, in most situations, wants to swing the golf club the same way every time (i.e., consistency).

In an effort to perfect a golf swing, golfer may practice regularly or take lessons. Practice is the only known way that a golfer may improve the consistency of his or her golf swing. However, to improve the technical aspects (i.e., mechanics) of his or her swing, a golfer will commonly hire a golf pro at a golf resort or golf course to teach a lesson. The golf pro is an expert at golf, and has the advantage of being able to observe students swinging the club during a lesson. By observation, a golf pro may readily determine what the student is doing right or wrong. Then, the golf pro may suggest to the student different ways to improve the swing. For example, the student may not be following-through properly, may not be keeping his or her head down, may not be keeping his or her arms straight, etc. Additionally, the golf pro may recommend some training exercise for practicing the recommended changes to the student's swing. Accordingly, lessons are very effective.

However, there is the disadvantage that once a student leaves the lesson that he or she may forget exactly how to swing the club in accordance with the golf pro's instructions. That is, the student may not remember the exact "feel" of the swing. Furthermore, when practicing without an observer, it is extremely difficult for a golfer to recognize what he or she is doing wrong. Therefore, many golfers have difficulty attaining the desired goals of golf lessons.

Another disadvantage of lessons are the cost. Golf lessons can be very expensive and impractical. A person might not have time to attend a lesson or lessons might not be taught in a location that is close.

Driving ranges are also available for the golfer to be able to practice hitting the ball in succession. However, hitting one golf ball after another does not, on its own, help the golfer improve the mechanics of the swing, and a golfer might only learn how to hit a "bad shot" consistently. The problem that golfers face in improving the golf swing is an unawareness of what is wrong with the current golf swing.

Therefore, there is a need for new and improved systems and methods for allowing a golfer to observe the mechanics of his or her own swing.

BRIEF SUMMARY OF THE INVENTION

The present invention is a golf training device that allows a golfer to observe and adjust the mechanical aspect of his or her own swing. For example, the present invention provides a systems and methods for observing backswing, follow-through, when the hands turn over, whether the arms are straight, whether the head or shoulders are properly aligned, etc.

According to an embodiment of the present invention, a golf training device is provided to help a golfer improve a golf swing. The device includes a base member, a mast member, and at least one swing indicator. The mast member is coupled with the base member and has opposite ends and a plurality of holes. The swing indicator(s) are insertable into at least one of said plurality of holes.

According to another embodiment of the present invention, a golf training device is provided. The device includes a base member means, a mast member means, and at least one swing indicator means. The at least one swing indicator means is for providing a visual or sensory indication to a golfer of at least one aspect of a golf swing. The mast means is for providing support to the at least one swing indicator means. The base means is for providing support to said mast means.

According to another embodiment of the present invention, a method is provided for practicing a golf swing using a golf training device. The golf training device includes a base member and mast member coupled with the base member. The mast member has opposite ends and a plurality of holes. The device also includes at least one swing indicator insertable into at least one of the plurality of holes. The method includes the steps of inserting at least one swing indicator through one of the plurality of holes based upon the height of a golfer planning on using the device, and a step of swinging a golf club while utilizing the at least one swing indicator as a visual indication to guide the swing.

BRIEF DESCRIPTION OF THE DRAWINGS

The objects and features of the invention will be more readily understood with reference to the following description and the attached drawings, wherein.

DETAILED DESCRIPTION OF THE PREFERRED EMBODIMENTS

Given the busy schedules that many individuals lead, it is an advantage for both the novice and professional golfer to be able to practice a golf swing at any time and at any place. According to an embodiment of the present invention, a portable golf training device is provided which can be taken to a driving range where the golfers can practice their swings. The golf training device is preferably for both indoor or outdoor use. The present invention was created with this freedom of practice location and practice time in mind.

Figure 1:
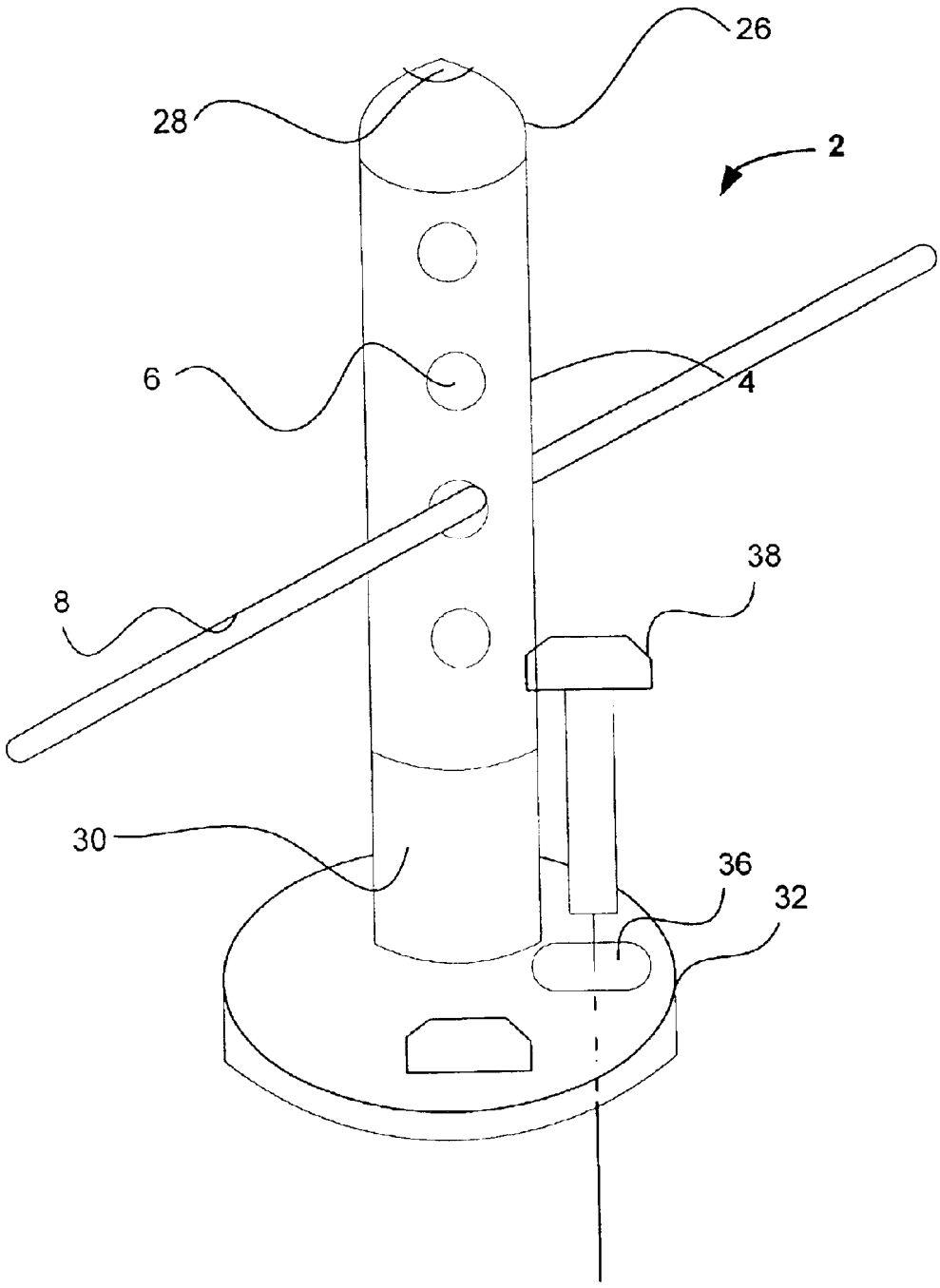
FIG. 1 is a perspective view of a golf training device according to an embodiment of the present invention.

FIG. 1 illustrates a golf training device 2 according to an embodiment of the present invention. The golf training device 2 provides a number of sensory indicators which allow a golfer to observe mechanical aspects of his or her swing. The golf training device 2 may include a main mast 4, a base member 30, and one or more guide wands or indicators, such as guide wand 8.

Figure 2A:
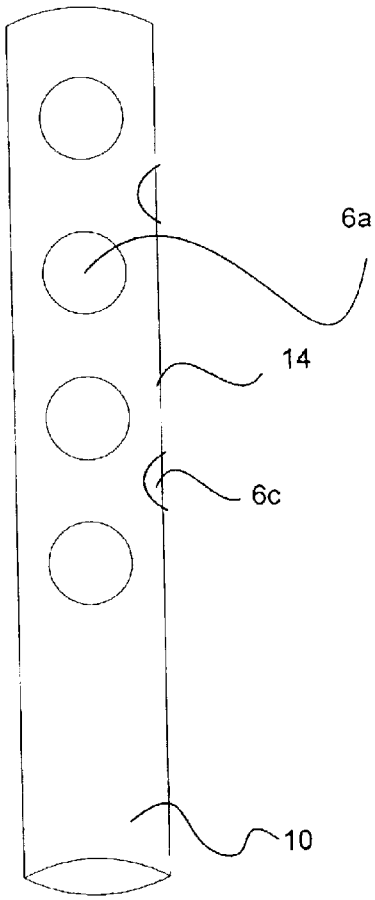
FIG. 2 is an illustration of the front and back of the main mast according to an embodiment of the present invention.
Figure 2B:
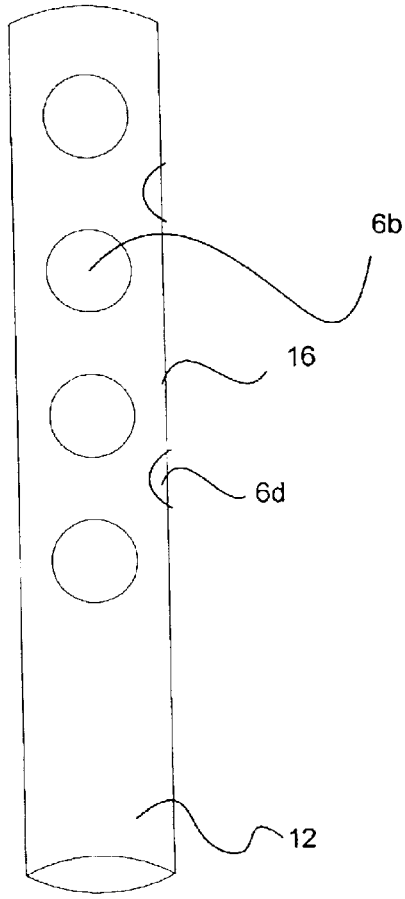
Figure 3:
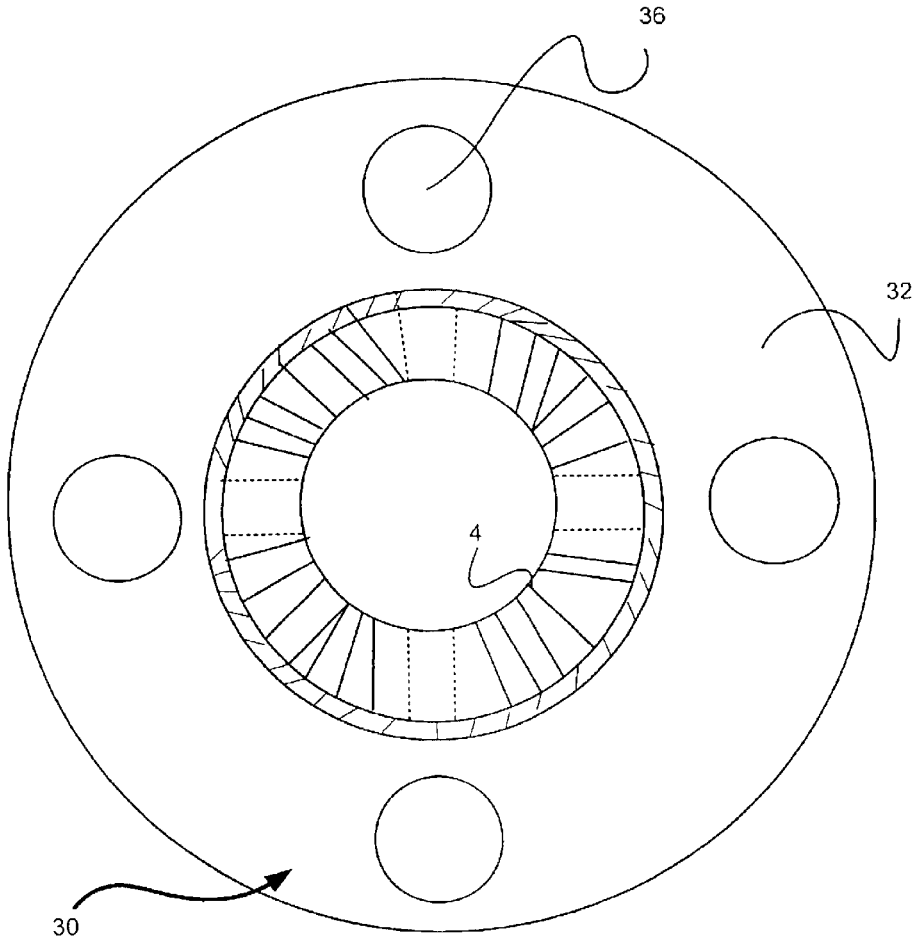
FIG. 3 is a cross sectional view of a top of the device according to an embodiment of the present invention.

The main mast 4 has opposite first 22 and second 24 ends (shown in FIGS. 2*a* and 2*b*). One of the first or second ends may be inserted into the base member 30 (a cross sectional top view of the device also shown in FIG. 3). The other end of the main mast 4 may be capped with a finishing cap 26. Accordingly, the base member 30 may be, for example, a cylindrical member having a flanged end 32 for removably accepting the main mast 4. Base member 30 is intended to provide support for the entire device 2 and therefore, may be of any size, shape and weight, necessary. However, since the device 2 is preferably portable, base member 30 is preferably a suitable size for carrying. The diameter or size of the flanged end portion of the base member may be such that the golf training device does not easily tip over when in use and can remain stable on a ground or floor surface. For example, the flanged end portion 32 of the base member 30 may have a diameter or size that is two times larger than the diameter of the main mast 4.

The main mast 4 can be placed into the center portion of the base member 30 such that the main mast 4 can extend vertically from the base member 30. Preferably, the main mast 4 should fit tightly into the base member 30 for structural stability.

In order to provide additional support to the device, base member 30 may also be fastened to the ground, floor, etc. upon which it is resting, by a fastening means, such as stakes or screws. Accordingly, the base member 30 may have through-holes or slots 36 for securing the base to a surface. The through-holes 36 allow fastening members 38 to pass through and fix the base member 30 to a ground surface. The fastening members 38 can be a screw, a spike, peg, stake or any other member that can pass through the through-holes 36 in the flanged end portion 32 and fasten base member 30 to the ground to steady the device 2 and prevent the device from tipping over when in use.

The main mast 4 has at least one means for attaching guide wand 8 as a visual or sensor indicator for a golfer to use during practice. For example, the main mast 4 can be a cylindrical elongate member having a plurality of uniform holes 6 for accepting the wand guide 8. The holes 6 may be arranged in any order in order to provide a number of different heights and angles for fixing the guide wand 8. For example, the holes 6 may be arranged in four columns along the length of the main mast 4, 90 degrees apart and equally spaced vertically. Of course, other known means for attaching the guide wand 8 to the mast may be used, such as hinges, fittings or couplings.

The height of golf training device 2 can be any height necessary to provide a number of visual or sensory indicators according to the present invention. Preferably, the device 2 may be approximately 3 feet in height so that guide wand 8 can be inserted in either higher or lower holes in order to set the guide wand 8 to be effective for golfers of various heights. Furthermore, depending on the exercise being performed by the golfer, guide wand 8 may be set at different heights as well.

FIGS. 2*a* and 2*b* show two different sides of an exemplary main mast 4. A first set of holes 6*a* may be located on a first side 10 of the main mast 4, and a second set of holes 6*b* is located on a second side 12 opposite to the first set of holes 6*a*. A second set of holes 6*b* on the second side 12 may be disposed directly across from the first set of holes 6*a* on the first side 10 of the main mast 4 so that when the guide wand 8 is inserted from a first hole 6*a* to a second hole 6*b*, the guide wand 8 can be parallel to the ground. The main mast 4 also may have a third set of holes 6*c* on a third side 14 and a fourth set of holes 6*d* on a fourth side 16. Preferably, each of the columns of holes 6 is disposed at 90-degree intervals. The holes 6 in the body of the main mast 4 can be of any size or shape. A preferred size of the holes allows a one-quarter inch guide wand 8 (e.g., a flexible dowel) to slidably fit into and pass through any of the holes 6*a*, 6*b*, 6*c* and 6*d* in the main mast 4.

Figure 6A:
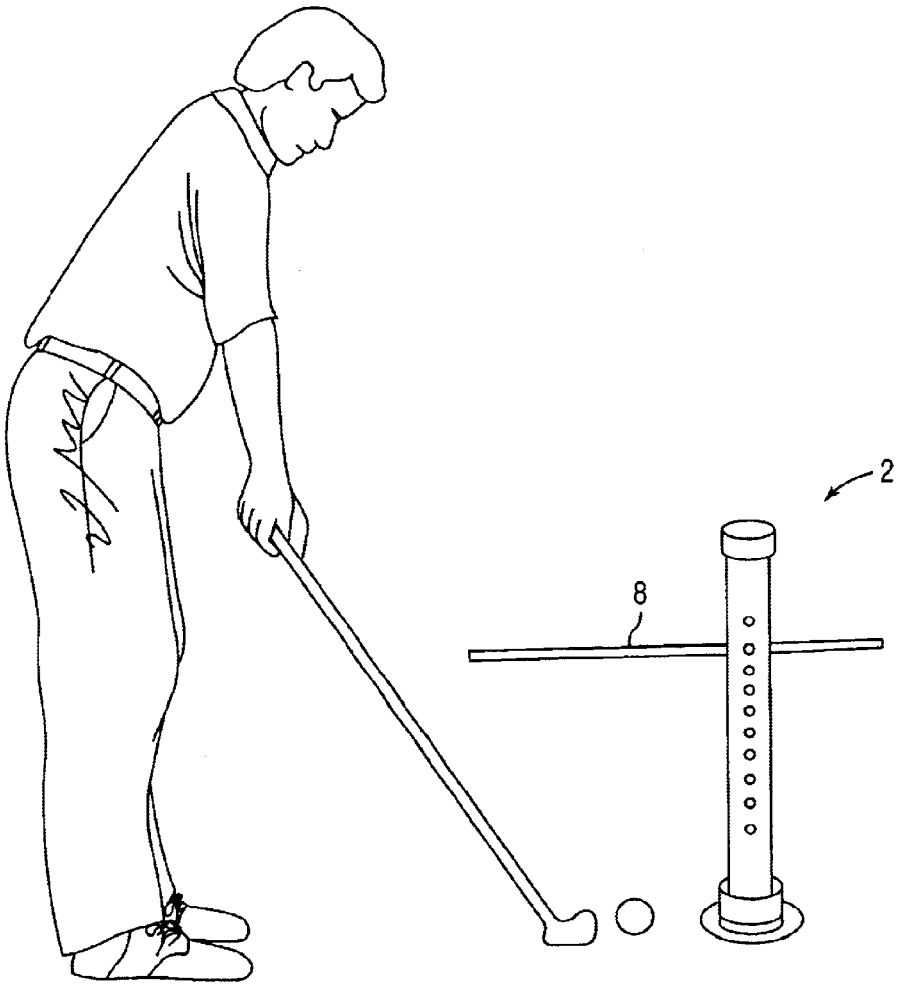
FIGS. 6*a*–6*c* are illustrations of a golfer using the device of the present invention.
Figure 6B:
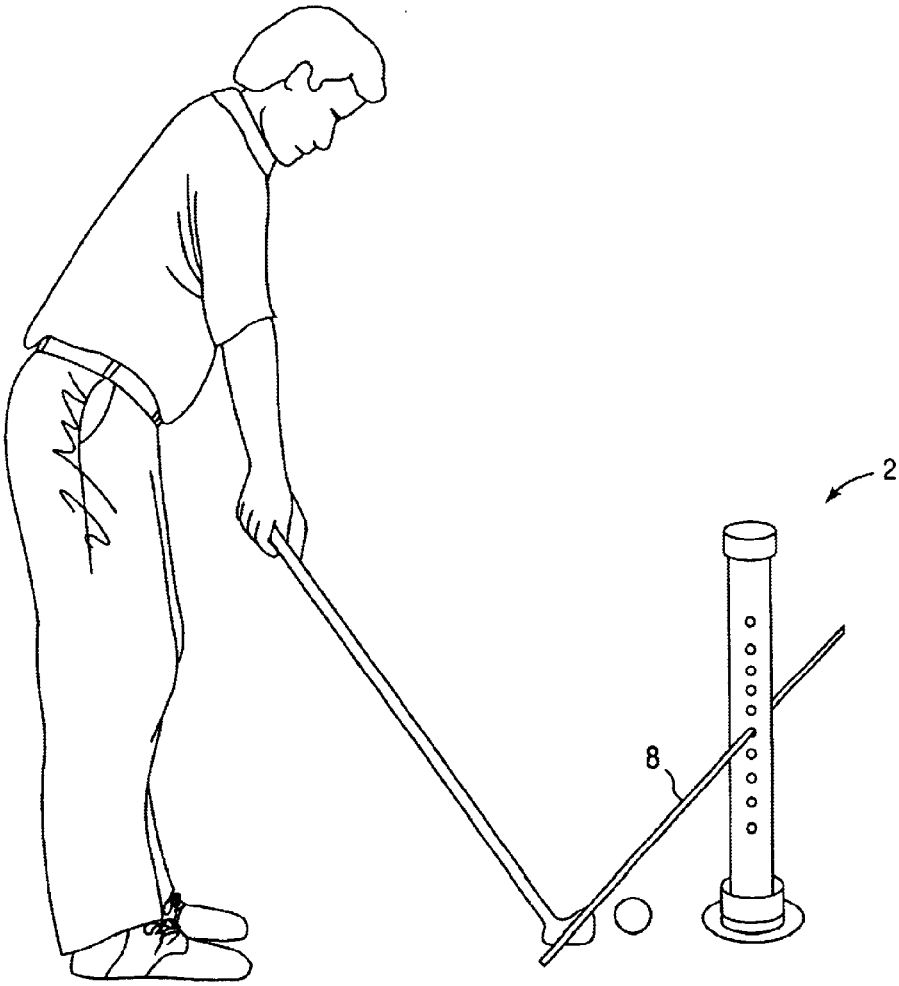
Figure 6C:
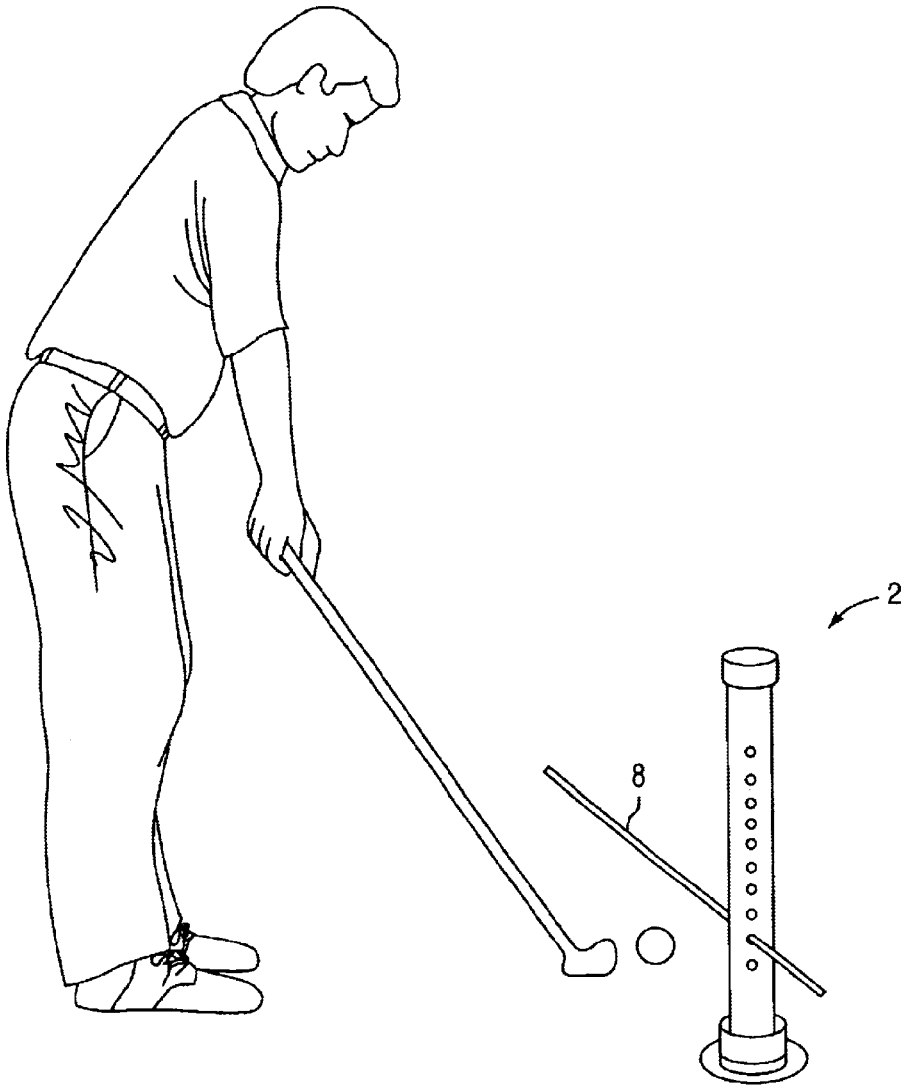

The guide wand 8 may be inserted into the main mast 4 so that it extended outward from the main mast 4 in a direction relative to the golfer to provide a visual or sensory indicator. For example, the wand may be extended directly to a golfers hands as shown in FIG. 6A, when the golfer is facing the device 2. In such an arrangement, the golfer can practice when to turn-over the hands. The indications is a visual aide. In another arrangement shown is FIG. 6B, the golfer can practice taking a backswing by following the guide wand 8 with the club head. In this manner, the golfer can get an indication of whether his or her arms are straight or whether the backswing is proper. Similarly, the golfer can slide the guide wand 8 through the mast so that the guide wand extends to the left of the golfer as shown in FIG. 6C, in order to practice the follow through. The guide wand 8 may be set to provide other swing indications, such as to strike the knees or waist to allow repetition of certain exercises that improve certain aspects of a golf swing.

As described above, the golf training device 2 of the present invention allows a golfer to perfect the golf swing by providing visual and other sensory indicators that allow the golfer to recognize improper mechanics so that the necessary corrections can be made without the need of an observer. These indicators or guide wands 8 can be manufactured from any suitable material, for example, PVC plastic and can be of any appropriate size and length. Moreover, guide wands 8 may be stiff or flexible, straight or curved, in order to obtain the desired effects.

Figure 4:
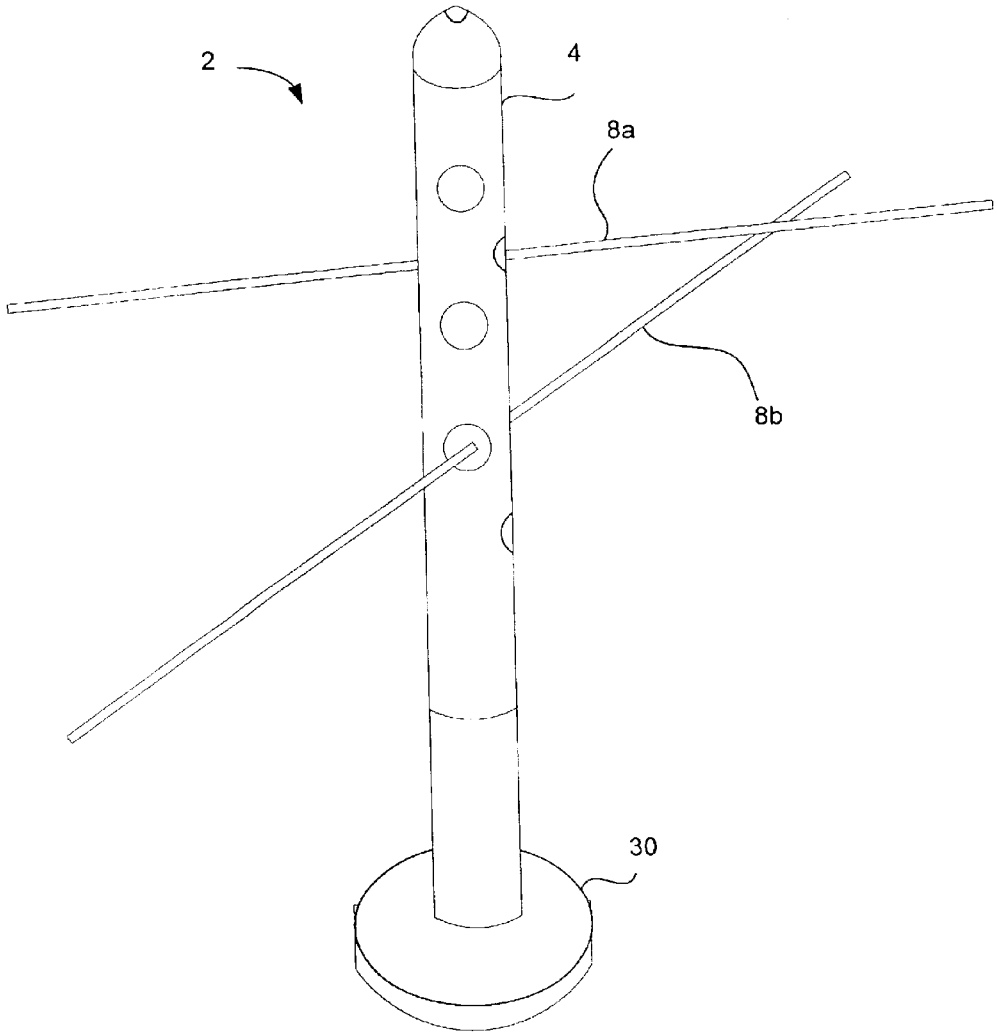
FIG. 4 is an illustration of a configuration of the present invention.

Multiple guide wands 8 may also be inserted through the first 6*a* and second 6*b* set of holes in the main mast, as sown in FIG. 4. When inserted, the guide wand 8 extends horizontally beyond the outer surface of the main mast 4 as necessary to provide the desired indication.

Two guide wands 8*a*, 8*b* can be used to indicate the proper swing as well as the proper positioning of the golfer's body during the golf swing. For example, a first guide wand 8*a* can be inserted through the holes 6*a*, 6*b* in the first 10 and second 12 sides of the main mast 4. A second guide wand 8*b* can be inserted through the holes 6*c*, 6*d* in the third 14 and fourth 16 sides of the main mast 4. In this exemplary arrangement, the first guide wand 8*a* is perpendicular to the second guide wand 8*b* and may be used on a swing indicator. The second guide wand 8*b* may be used as a shifting weight indicator. As a shifting weight indicator, the second guide wand 8*b* may be inserted through the holes in the main mast so that the golfer's knees are level with the side of the wand. The golfer can then stand between the first and second guide wands 8*a*, 8*b* facing, for example, the first guide wand 8*a*. When the golfer swings, the golf club should run parallel to the first guide wand 8*a*. Then, as the golfer turns through the swing, the golfer's knees should touch the wand 8*b*, which acts as a barrier to prevent the knees and waist from overextending during the swing. Using the two guide wands

8*a*, 8*b* the golfer can monitor the position of the knees, waist and body during the swing and release. As a result, the golfer can recognize any mechanical deficiencies in his or her swing.

Figure 5:
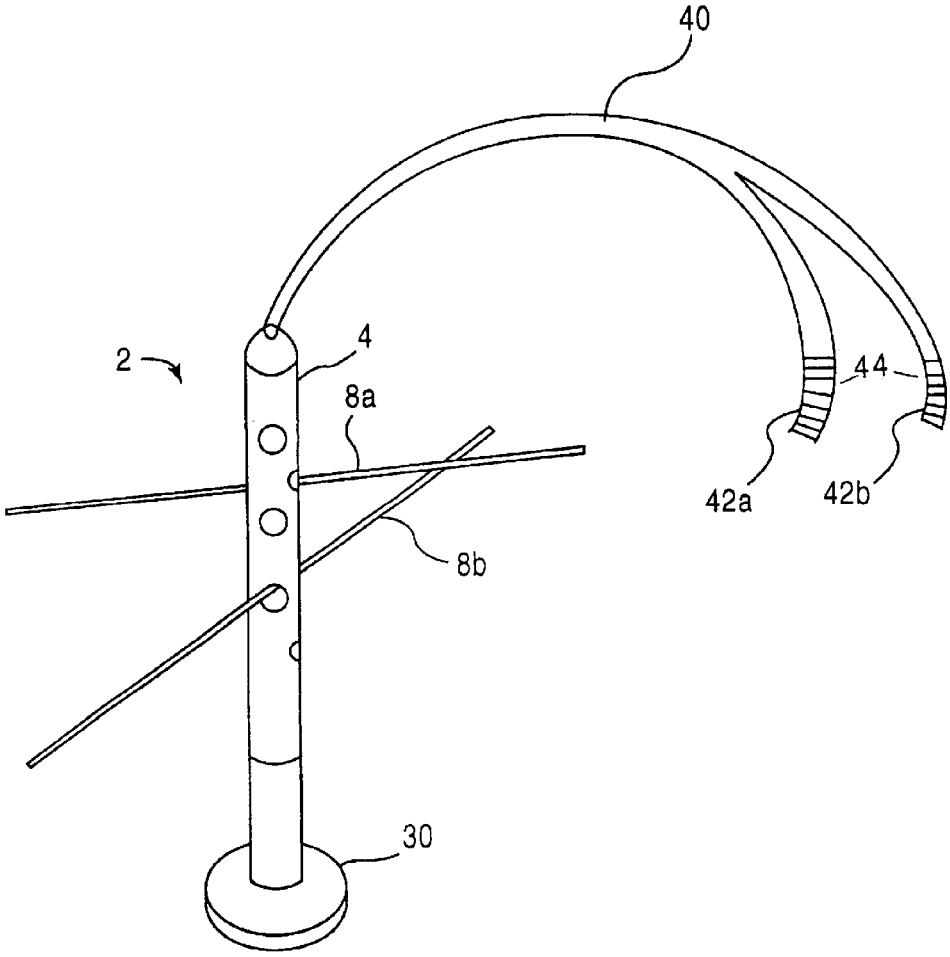
FIG. 5 is an illustration of another configuration of the present invention.

The main mast 4 may also be fitted with a head and shoulders indicator 40, as shown in FIG. 5. The head and shoulders indicator 40 can indicate whether the golfer maintains a good alignment of the head and shoulders during the golf swing. Keeping the head down during a swing is important for maintaining eye contact with the golf ball throughout the golf swing. It is well known that by maintaining eye contact with the golf ball, the golfer is more likely to hit a better shot.

The head and shoulders indicator 40 may be a flexible elongate member with split prongs for fitting over the shoulders as shown in FIG. 5. The shoulders indicator 40 may be fixed to a mast 4 by any known means which achieves the desired placement of the indicator. For example, the cap 26 is shown as having a hole 28 through a center portion of the upper surface. The head and shoulders indicator 40 may have one end 40*a* that may be inserted through the hole 28 in the cap. The other end 40*b* of the head and shoulders indicator 40 has at least two prongs 42. A first prong 42*a* may be longer than a second prong 42*b* to better fit, and may vary depending on the desired contrast, the handedness of the golfer, etc. In this example, the golf training device 2 may be positioned behind the golfer. Then, the second or shorter prong 42*b* is placed on the golfer's shoulders in the direction that the ball is intended to fly. The first or longer prong 42*a* is placed on the golfer's other shoulder, opposite the intended direction of the golf ball. The prongs 42*a*, 42*b* of the head and shoulders indicator reach over the back of the golfer's shoulder to hang in front of an upper part of the golfer's chest. The prongs 42*a*, 42*b* of the head and shoulders indicator are padded with padding 44 to provide comfort to the golfer. When the head and shoulders indicator 40 is in place, the golfer can practice monitor the position of the head and shoulders during the golf swing.

The parts of device 2 may be manufactured from any suitable material such as PVC plastic. Preferably, the entire device should be lightweight and durable. The wands and indicators are preferable made from flexible and unbreakable material. The guide wands and head and shoulders indicator are flexible so that they do not injure the golfer during use.

Figure 7:
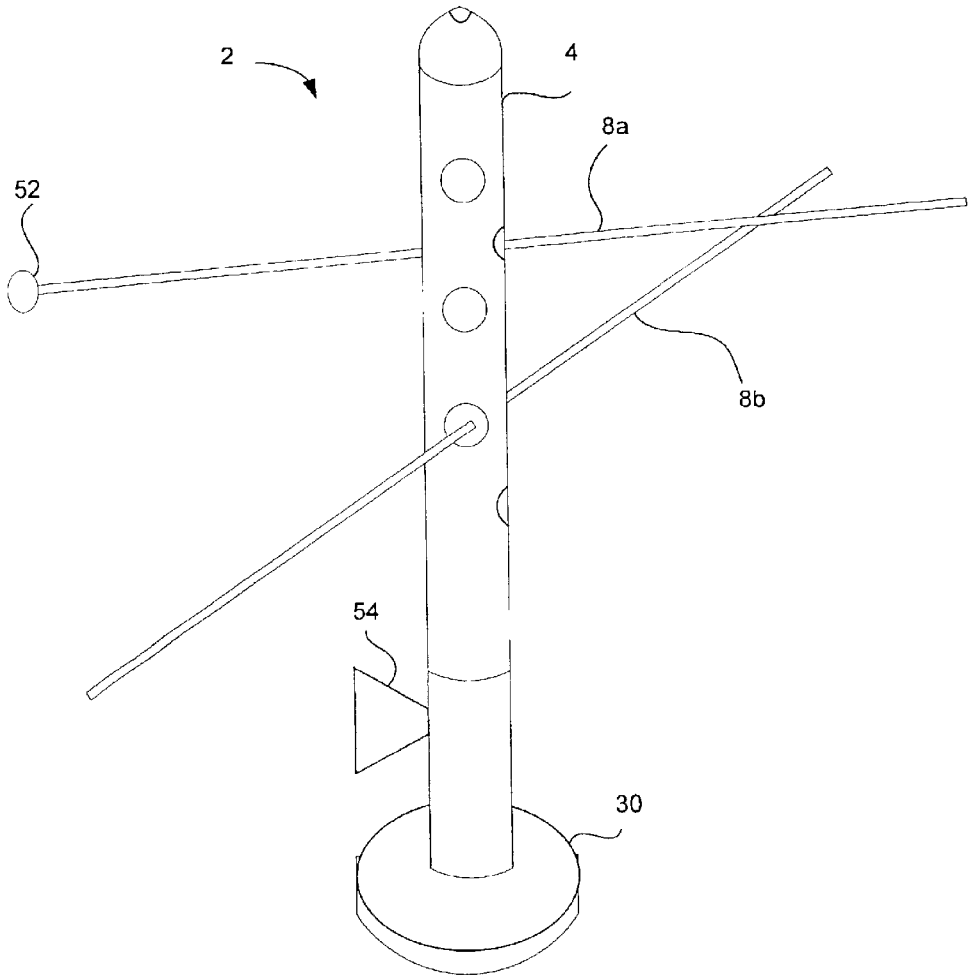
FIG. 7 is an illustration of another configuration of the present invention.

The golf training device 2 may also be equipped an audio system with a processor (not shown), having a sensing device 52 and a voice box 54, as shown in FIG. 7. The sensing device 52 and voice box 54 may be configured to work together to audibly indicate and inform the golfer whether the golf swings are straight, whether the golfer's head is in the proper position, etc. The audio system may include speakers 56, which may be mounted in the body of the main mast 4. Any number of sensors may be used with the device to indicate a number of positions.

The base member 30 can also be a weighted ring 30*a*. This provides greater mobility to the device because it can be quickly set up and easily used at a driving range or indoors without the need to secure the base member 30 to the surface. Similar to the PVC base member, one end of the main mast 4 may be inserted into the center portion of the weighted ring. Preferably, the mast 4 should fit tightly into the ring for stability. The weighted ring provides support for the main mast 4 and prevents the main mast from becoming unstable or tipping over during use. The weighted ring may be manufactured from any suitable material, such as, but not limited to, rubber, metal, or plastic.

It will be readily understood by one skilled in the art that the apparatus of the present invention may be used in many ways to adjust/practice many aspects of the golf game. The following are exemplary uses of the devices described herein. The listed uses are not meant to be an exhausted list, and it will be understood that there are many other uses of the device.

The golf training device may be used to detect head and upper body movement during all stages of a golf swing. As the golfer faces away from the device, the heads and shoulders indicator 40 may be inserted in the top of the main mast and placed over the head or shoulders of the golfer, as described above with reference to 5. The golfer then may take golf strokes as desired. As the golfer moves through the golf swing, any movement of the head or upper body will be indicated by movement of the wands.

The device may be used to indicate the correct line for the "follow through" portion of the golf swing. A guide wand may be inserted through an appropriate hole in the main mast, depending on the golfer's height, with the guide wand extending in the direction the ball is meant to travel (e.g., for a right-handed golfer, to the left). As the golfer swings the club, the guide wand provides a visual indication to guide the swing after the point at which the ball has been struck.

Similarly, the device may be used to indicate the correct line for the "back swing" portion of the golf swing. A guide wand may be inserted through the appropriate hole, with the wand extending in the direction opposite that which the ball is intended to travel (e.g., for right-handed golfers, to the right). As the golfer takes the club head back, the wand provides a visual indicator to guide the swing back to a point where the club head will be properly aligned to strike the ball.

The device may be used to indicate movements of the hips and knees on both the back swing and the follow through portions of the golf swing. The guide wand is inserted through a hole in the main mast at an appropriate height for the golfer, with the end of the guide wand extending out toward the golfer in a line perpendicular to the direction in which the ball is intended to travel. The golfer stands with the wand extending past his side (for a right-handed golfer, past his left side to measure follow through or his right side to measure movement on the back swing). As the golfer goes through this swing, the guide wand will provide a visual and tactile guide for hip and knee movement, such movement resulting in the golfer actually touching the wand during the swing.

The device may be used to indicate the appropriate points in the swing for weight shifts by the golfer. The guide wand is inserted in a hole extending toward the golfer in a direction perpendicular to the direction in which the ball is intended to travel. As the golfer swings, the wand gives a visual indication of the point in the swing at which the golfer must shift his weight from one foot to the other.

The device may be used to aid the golfer in aligning the club face at the point of impact with the ball. The guide wand is inserted in a hole extending toward the golfer perpendicular to the direction the ball is intended to travel. The guide wand extends directly over the ball so that, as the club passes through the point of impact, the wand provides a visual indication of the direction in which the club face is pointed as it strikes the ball.

The device may be used to indicate the point at which the golfer's hands should turn over in the swing, i.e., immediately prior to impact. The guide wand is inserted in the hold extending toward the golfer perpendicular to the direction the ball is intended to travel. The guide wand extends over or immediately behind the ball. As the club face passes through the point of impact, the wand provides a visual indication of the point at which the golfer should turn his hands over to accelerate the club head through impact.

The device may be used to indicate the proper turning motion of the shoulder through the golf swing. The guide wand is inserted through the top slanted hole, extending out to the golfer's shoulder. As the golfer swings, the wand provides indication of the amount of shoulder turn employed by the golfer during the back swing.

The device may be used to indicate movement of the golfer's body out of the normal position over the ball through the swing. The guide wand is inserted through the hold extending toward the golfer in a direction perpendicular that in which the ball is intended to travel. As the golfer moves through the swing, the wand provides a visual reference point to determine whether the golfer's body has moved sideway out of position with respect to the ball.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A golf training device comprising:

a base member;

a mast member counted with said base member, said mast member having opposite ends and a plurality of holes; and at least one swing indicator insertable into at least one of said plurality of holes, wherein said at least one swing indicator passes completely through said mast member, wherein the base member comprises a hollow cylindrical member having a flanged end portion extending orthogonal relative to a longitudinal axis of said mast member, wherein said mast member further comprises a first end and a second end opposite said first end, wherein said second end of said mast member is coupled to said base member, and wherein a head and shoulders indicator is securable to said first end of said mast member, and wherein said device further comprises a cap disposed on said first end of the mast member and said head and shoulders indicator is coupled to an upper surface of the cap, wherein said head and shoulders indicator comprises a forked, multi-pronged elongated member having at least two prongs branching from the fork, said at least two prongs being configured to fit across a golfer's shoulders.

2. The golf training device according to claim 1, wherein the plurality of holes are vertically arranged in a plurality of columns, each column being disposed opposite another column of said plurality of holes.

3. The golf training device according to claim 1, wherein the at least one swing indicator comprises a first swing indicator and a second swing indicator, the first swing indicator being configured to pass through a first hole and second hole and a second swing indicator being configured to pass through a third hole and a fourth hole.

4. The golf training device according to claim 1, wherein said flanged end portion has a plurality of through-holes.

5. The golf training device according to claim 4, further comprising fastening members inserted into the plurality of through-holes in the flanged end portion to fix the base member to a ground surface.

6. The golf training device according to claim 5, wherein the fastening members comprise at least one of a stake, screw, peg and spike.

7. The golf training device according to claim 1, wherein the at least one swing indicator comprises a guide wand.

8. The golf training device according to claim 7, wherein the mast member, base member and guide wand comprise PVC plastic.

9. The golf training device according to claim 1, wherein the device comprises rust proof material.

10. The golf training device according to claim 1, wherein the flanged end portion of the base member has a diameter that is at least two times larger than the diameter of the base member.

11. The golf training device according to claim 1, wherein the head and shoulders indicator has a first prong and a second prong, each prong for resting on an opposite shoulders of the user.

12. The golf training device according to claim 11, wherein the first prong is longer than the second prong.

13. The golf training device according to claim 11, wherein each prong of the head and shoulders indicator is padded.

14. The golf training device according to claim 1, wherein the base member comprises a weighted ring and the mast member is insertable into a center portion of the weighted ring.

15. A golf training device comprising:

at least one swing indicator means for providing a visual or sensory indication to a golfer of at least one aspect of a golf swing;

a mast means for providing support to said at least one swing indicator means; and a base means for providing support to said mast means, wherein said at least one swing indicator means pass completely through said mast means, wherein said base means includes a hollow cylindrical member having a flanged end portion extending orthogonal to a longitudinal axis of said mast means, wherein said mast member further comprises a first end and a second end opposite said first end, wherein said second end of said mast member is coupled to said base member, and wherein a head and shoulders indicator is securable to said first end of said mast member, and wherein said device further comprises a cap disposed on said first end of the mast member and said head and shoulders indicator is coupled to an upper surface of the cap, wherein said head and shoulders indicator comprises a forked, multi-pronged elongated member having at least two prongs branching from the fork, said at least two prongs being configured to fit across a golfer's shoulders.

16. The golf training device according to claim 15, wherein the mast means comprises a plurality of coupling means for securing said at least one swing indicator means thereto in a desired position.

17. The golf training device according to claim 15, wherein said base means comprises a plurality of fastening means for fastening said base means to a surface.

* * * * *